US009700939B2

(12) United States Patent
Lee et al.

(10) Patent No.: US 9,700,939 B2
(45) Date of Patent: Jul. 11, 2017

(54) APPARATUS FOR PRODUCING A COMPOSITE MATERIAL

(71) Applicant: KOREA INSTITUTE OF INDUSTRIAL TECHNOLOGY, Cheonan (KR)

(72) Inventors: Kyong Whoan Lee, Incheon (KR); Keoung Hwa Lee, Paju (KR); Hyun Jong Kim, Seoul (KR); Sang Mok Lee, Incheon (KR); Je Sik Shin, Bucheon (KR); Young Cheol Lee, Busan (KR)

(73) Assignee: KOREA INSTITUTE OF INDUSTRIAL TECHNOLOGY, Cheonan (KR)

( * ) Notice: Subject to any disclaimer, the term of this patent is extended or adjusted under 35 U.S.C. 154(b) by 264 days.

(21) Appl. No.: 14/407,920

(22) PCT Filed: Jun. 11, 2013

(86) PCT No.: PCT/KR2013/005141
§ 371 (c)(1),
(2) Date: Dec. 12, 2014

(87) PCT Pub. No.: WO2013/187671
PCT Pub. Date: Dec. 19, 2013

(65) Prior Publication Data

US 2015/0123325 A1 May 7, 2015

(30) Foreign Application Priority Data

Jun. 15, 2012 (KR) ..... 10-2012-0064581

(51) Int. Cl.
*B22D 19/14* (2006.01)
*B22D 21/00* (2006.01)
(Continued)

(52) U.S. Cl.
CPC ..... *B22D 19/14* (2013.01); *B22D 21/007* (2013.01); *B22D 45/00* (2013.01); *C22C 1/1036* (2013.01);
(Continued)

(58) Field of Classification Search
CPC ..... B22D 45/00; B22D 19/14; B22D 21/007
(Continued)

(56) References Cited

U.S. PATENT DOCUMENTS

| | | | | |
|---|---|---|---|---|
| 2004/0035548 | A1* | 2/2004 | Koide | B22D 19/14 164/98 |
| 2010/0192727 | A1* | 8/2010 | Withers | B22D 27/02 75/10.67 |
| 2015/0123325 | A1* | 5/2015 | Lee | B22D 19/14 266/234 |

FOREIGN PATENT DOCUMENTS

| | | | |
|---|---|---|---|
| JP | H 08-174166 | A | 12/2004 |
| KR | 10-2007-0115952 | A | 12/2007 |
| KR | 10-2010-0008733 | A | 1/2010 |

OTHER PUBLICATIONS

PCT International Search Report dated Sep. 2, 2013, issued in International Application No. PCT/KR2013/005141 (5 pages).
(Continued)

*Primary Examiner* — Scott Kastler
(74) *Attorney, Agent, or Firm* — Finnegan, Henderson, Farabow, Garrett & Dunner LLP

(57) ABSTRACT

The present invention includes a first injection tube for supplying a colloidal medium, a storage part connected to the first injection tube for receiving the colloidal medium through the first injection tube, a second injection tube connected to the storage part for supplying a colloid, a discharge tube connected to both the storage part and the second injection tube for discharging the colloidal medium coming from the storage part and the colloid coming from
(Continued)

the second injection tube, and a free surface inversion part for inverting the free surface of the liquid in the second injection tube so as to mix the colloidal medium and the colloid in the discharge tube.

4 Claims, 2 Drawing Sheets

(51) Int. Cl.
*B22D 45/00* (2006.01)
*C22C 32/00* (2006.01)
*C22C 1/10* (2006.01)
*C22C 26/00* (2006.01)

(52) U.S. Cl.
CPC ..... *C22C 26/00* (2013.01); *C22C 32/0084* (2013.01); *B22F 2999/00* (2013.01)

(58) Field of Classification Search
USPC ..... 266/234
See application file for complete search history.

(56) References Cited

OTHER PUBLICATIONS

Sathuvalli, Udaya B., et al., "Electromagnetic Force Calculations for a Conical Coil", *Metallurgical Transactions B*, vol. 24B, Oct. 1993, pp. 737-748.

* cited by examiner

APPARATUS FOR PRODUCING A COMPOSITE MATERIAL

CROSS REFERENCE TO RELATED APPLICATIONS

This application is a national stage filing under 35 U.S.C. §371 of International Application No. PCT/KR2013/005141 filed on Jun. 11, 2013, which claims priority to Korean Patent Application No. 10-2012-0064581, filed on Jun. 15, 2012, the content of each application being incorporated herein by reference.

TECHNICAL FIELD

The present invention relates to an apparatus for producing a composite material, and more particularly, to an apparatus for producing a composite material which can continuously and uniformly disperse dispersion particles into a dispersion medium having a higher specific gravity than the dispersion particles.

BACKGROUND

With the development of industrial technologies, materials are required to have various characteristics, thereby making it difficult to satisfy required characteristics only with inherent properties of the materials. For this reason, demand for composite materials is gradually increasing.

Copper and aluminum have been widely used for heat exchangers or heat sinks, and in recent years, heat dissipation materials are required to have light weight, high strength, and higher thermal conductivity on account of high energy density caused by high functionality and efficiency of devices.

Aluminum, which is a lightweight material, has attracted a lot of attention as a heat dissipation material and is inevitably alloyed to achieve proper mechanical properties for heat dissipation materials. Alloying of aluminum may degrade thermal and electric conductivity in spite of enhancement of machinability and mechanical properties of aluminum materials.

Accordingly, in order to improve thermal and electrical conductivity as well as mechanical properties, there have emerged technologies for combining aluminum with nano-materials, such as carbon nanotubes, exhibiting better thermal and electric properties than aluminum, thereby utilizing thermal and electric properties of nano-materials and improving mechanical properties of structural materials through dispersion strengthening, instead of typical metallurgical methods.

Powder metallurgy has been widely used to produce composite materials and has also achieved some results in compositeness of carbon nanotubes. However, powder metallurgy is inadequate to respond to increasing demands for composite materials in terms of economic feasibility and scale-up. Therefore, a lot of attention is being focused on composite technologies using casting.

In the production of carbon nanotube-aluminum composite materials through typical casting, a problem of dipping carbon nanotubes, which are dispersion particles, into molten aluminum, which is a dispersion medium, has to be solved first. However, the dispersion particles have a lower specific gravity than the dispersion medium in the carbon nanotube-aluminum composite materials, and thus the dispersion particles are difficult to dip into the dispersion medium due to buoyant force.

The present invention relates to a technology for production of composite materials, such as carbon nanotube-aluminum composite materials, in which dispersion particles are lighter than a dispersion medium.

The background technique of the present invention is disclosed in Korean Patent Publication No. 10-2010-0008733 (published on Jan. 26, 2010 and entitled "Heat sink with composite material having covalently bonded carbon nanotube").

SUMMARY

Since typical carbon nanotubes are not easily mixed with molten aluminum due to their lower specific gravity and low dispersibility in aluminum, powder metallurgy or a technology for stacking carbon nanotubes on an aluminum foil is applied, thereby making it difficult to achieve mass production of aluminum-carbon nanotube composite materials.

Therefore, there is a need for overcoming the aforementioned problems.

An aspect of the present invention is to provide an apparatus for producing a composite material which can uniformly disperse dispersion particles in a dispersion medium having a higher specific gravity than the dispersion particles.

In accordance with one aspect of the present invention, an apparatus for producing a composite material includes: a first injection tube supplying a dispersion medium; a reservoir connected to the first injection tube and receiving the dispersion medium through the first injection tube; a second injection tube connected to the reservoir and supplying dispersion particles; a discharge tube connected to the reservoir and the second injection tube and discharging a mixture of the dispersion medium supplied from the reservoir and the dispersion particles supplied from the second injection tube; and a free surface inversion unit directing a free surface of a liquid in the second injection tube vertically downward such that the dispersion medium and the dispersion particles are mixed with each other inside the discharge tube.

The reservoir may be formed of a closed loop pipe, and the discharge tube may communicate with the reservoir and extend upward therefrom.

The free surface inversion unit may include a coil generating an induced current inside the reservoir, and an electromagnet disposed at a connection portion between the second injection tube and the discharge tube.

The electromagnet may control Lorentz force by generating a magnetic field in a direction perpendicular to the induced current of the coil.

The apparatus may further include a cooling unit provided to the discharge tube and cooling a composite material which is the mixture of the dispersion medium and the dispersion particles, and an extraction unit drawing up the composite material discharged from the cooling unit.

Embodiments of the present invention provide an apparatus for producing a composite material, which can supply dispersion particles to a lower portion of a dispersion medium having a higher specific gravity than the dispersion particles in the gravitational field such that the dispersion medium is impregnated with the dispersion particles naturally moving upward by buoyant force, thereby easily producing a composite material with uniformly distributed dispersion particles.

In addition, according to the embodiments of the invention, a molten metal in which dispersion particles are uniformly dispersed in a dispersion medium can be continuously cooled, solidified, and then extracted while moving upward, thereby achieving mass production of composite materials.

DETAILED DESCRIPTION

Hereinafter, exemplary embodiments of the present invention will be described in detail with reference to the accompanying drawings.

It should be noted that the drawings are not to precise scale and may be exaggerated in thickness of lines or size of components for descriptive convenience and clarity.

In addition, terms used herein are defined by taking functions of the present invention into account and can be changed according to user or operator custom or intention.

Therefore, definition of the terms should be made according to the overall disclosure set forth herein.

Figure 1:
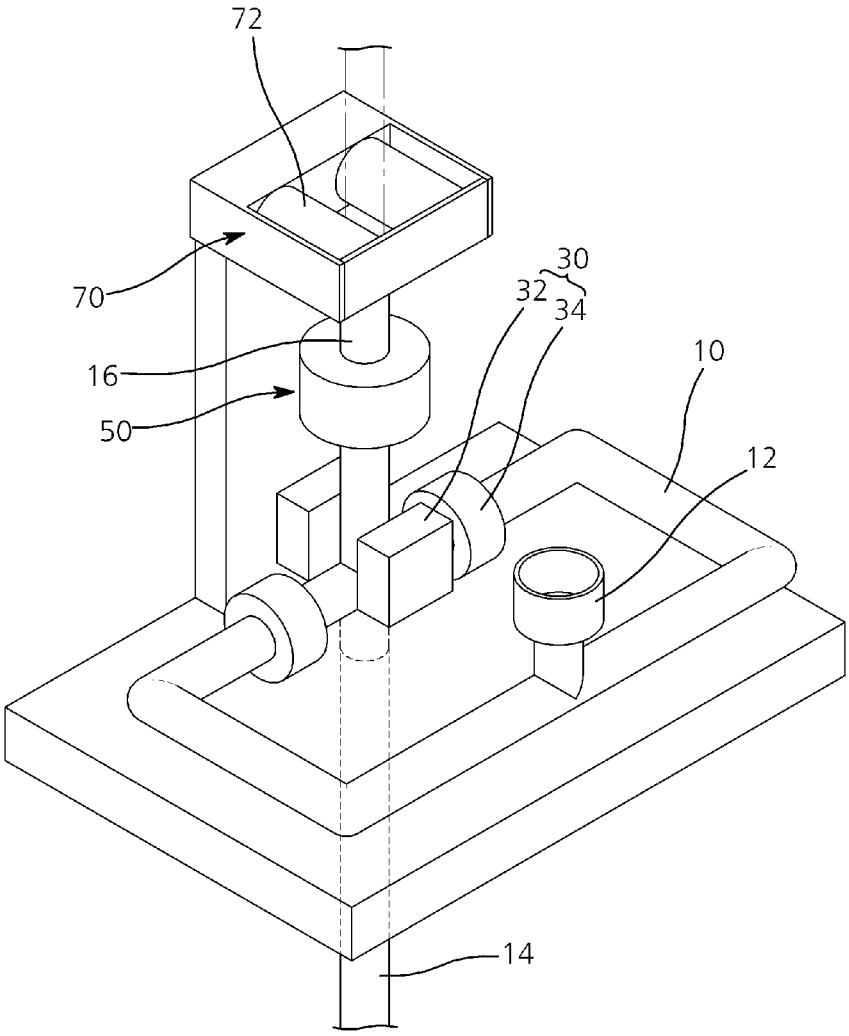
FIG. 1 is a perspective view of an apparatus for producing a composite material according to one embodiment of the present invention.
Figure 2:
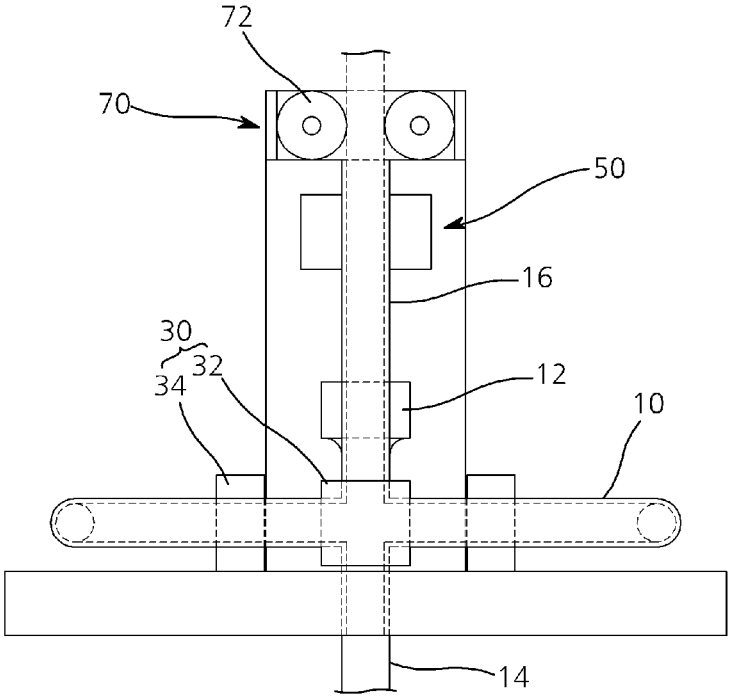
FIG. 2 is a front view of the apparatus for producing a composite material according to the embodiment of the present invention.
Figure 3:
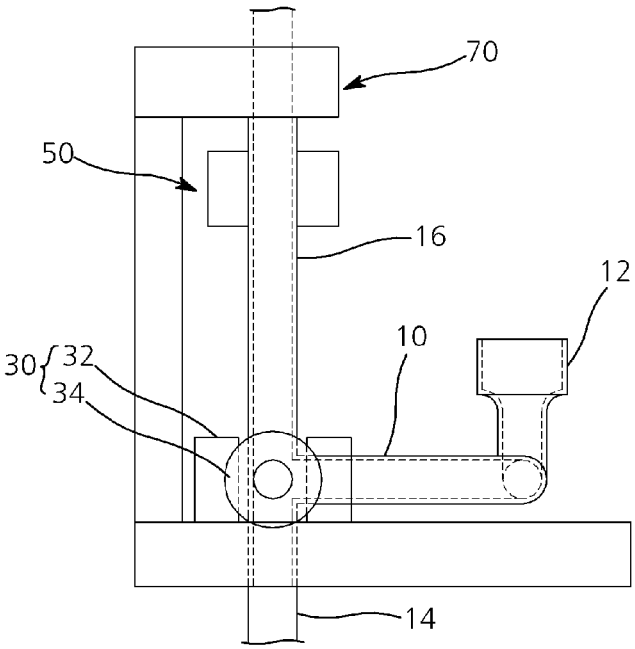
FIG. 3 is a side view of the apparatus for producing a composite material according to the embodiment of the present invention.

FIG. 1 is a perspective view of an apparatus for producing a composite material according to one embodiment of the present invention, FIG. 2 is a front view of the apparatus for producing a composite material according to the embodiment of the present invention, and FIG. 3 is a side view of the apparatus for producing a composite material according to the embodiment of the present invention.

Referring to FIGS. 1 to 3, the apparatus for producing a composite material according to the embodiment of the invention includes a first injection tube 12 supplying a dispersion medium, a reservoir 10 connected to the first injection tube 12 and receiving the dispersion medium through the first injection tube 12, a second injection tube 14 connected to the reservoir 10 and supplying dispersion particles, and a discharge tube 16 connected to the reservoir 10 and the second injection tube 14 such that a mixture of the dispersion medium supplied from the reservoir 10 and the dispersion particles supplied from the second injection tube 14 is discharged therethrough.

In addition, the apparatus according to the embodiment of the invention further includes a free surface inversion unit 30 directing a free surface of a liquid in the second injection tube 14 vertically downward such that the dispersion medium and the dispersion particles are mixed with each other inside the discharge tube 16.

The free surface inversion unit 30 includes coils 34 generating an induced current inside the reservoir 10 and electromagnets 32 inducing a Lorentz force acting on a connection portion between the second injection tube 14 and the discharge tube 16.

The reservoir 10 is formed of a closed loop pipe having a rectangular or circular shape (“ ” or “O”). The first injection tube 12 and the discharge tube 16 communicate with the reservoir 10 and extend upward therefrom, and the second injection tube 14 communicates with the reservoir 10 and extends downward therefrom.

The reservoir 10 is provided at a proper place thereof with a thermometer 11, such as at least one thermocouple for measuring temperature of the dispersion medium inside the pipe.

One or more coils 34 may be disposed at proper places to surround the reservoir 10, as needed.

The electromagnets 32 are disposed at a connection portion between the discharge tube 16 and the reservoir 10 to generate a magnetic field in a direction perpendicular to the induced current of the coils 34, and magnetic poles thereof are arranged to exert a Lorentz force directed toward the discharge tube 16.

In addition, the apparatus for producing a composite material according to the embodiment of the invention further includes a cooling unit 50 cooling a composite material, which is a mixture of the dispersion medium and the dispersion particles, moving upward through the discharge tube 16, and an extraction unit 70 drawing up the composite material discharging from the cooling unit 50. In this embodiment, the extraction unit 70 serves to draw up the composite material cooled and solidified by the cooling unit 50.

The cooling unit 50 may cool the composite material by water cooling, air cooling, or a combination thereof, and is provided with a solid-liquid interface thermometer 51, such as a thermocouple, for identifying a location of a solid-liquid interface.

The extraction unit 70 is separated a proper distance upward from the cooling unit 50 in view of usability and cooling conditions.

The extraction unit 70 includes extraction rollers 72 drawing up the composite material solidified by the cooling unit 50. At least one pair of extraction rollers 72 may be disposed to achieve efficient extraction of the composite material.

The dispersion medium includes a metallic material, such as copper, aluminum, iron, or stainless steel, which may be supplied as a molten metal through heating, and dispersion particles includes a carbonaceous material such as carbon nanotube, a metallic oxide, or a ceramic material.

Operation of the apparatus for producing an Al-carbon nanotube composite material according to the embodiment of the invention will be described as follows.

Molten aluminum is injected into the reservoir 10 through the first injection tube 12, with the second injection tube 14 closed, and current is applied to the coils 34 to generate an induced current in the molten aluminum, thereby heating the molten aluminum.

When the molten aluminum is heated to a proper temperature, current is applied to the electromagnets 32. Due to this, Lorentz force directed toward the discharge tube 16 is induced between the discharge tube 16 and the second injection tube 14. When the force is equal to a static pressure of the molten aluminum, the molten aluminum does not move downward even though the second injection tube 14 is open.

Therefore, a free surface of the molten aluminum at an inlet of the second injection tube 14 is inverted to face the ground.

Then, carbon nanotubes may be fed into the molten aluminum through the second injection tube 14.

The temperature of the molten aluminum inside the reservoir 10 may be measured using the thermometer 11 such as a thermocouple and maintained at a constant level by controlling the current applied to the coils 34. Since the magnitude of the Lorentz force is proportional to the product of the current induced by the coils 34 and a magnetic force, the Lorentz force may be kept uniform by inversely controlling the current applied to the electromagnets 32 according to the temperature of the molten aluminum inside the reservoir 10.

The amount of the molten aluminum moving upward through the discharge tube 16 is proportional to the amount of composite material drawn up by the extraction unit 70, and the molten aluminum is mixed with the carbon nanotube fed through the second injection tube 14 while rising through the discharge tube 16 after horizontal movement through the reservoir 10.

Since the carbon nanotube is injected through the inverted free surface of the molten aluminum, the carbon nanotube is smoothly raised by a buoyant force thereof through the molten aluminum and stuck to a solid-liquid interface formed at an intermediate location of the cooling unit 50.

The location of the solid-liquid interface is identified by measuring the temperature of the cooling unit 50 with the solid-liquid interface thermometer 51 such as a thermocouple, and an extraction speed of the extraction unit 70 is uniformly controlled and maintained in conjunction with the amount of carbon nanotube injected.

Therefore, workability can be stabilized, and a carbon nanotube-aluminum composite material can be attained in which carbon nanotubes are uniformly dispersed at a solid-liquid interface of molten aluminum.

Continuous repetition of the operations described above makes it possible to mass produce aluminum-carbon nanotube composite materials.

As such, the present invention provides the apparatus for producing a composite material, which can uniformly disperse dispersion particles into a dispersion medium having a higher specific gravity than the dispersion particles.

Although one embodiment has been described above with reference to the accompanying drawings, it should be understood that this embodiment is given by way of illustration only, and that various modifications, variations, and alterations can be made without departing from the spirit and scope of the present invention.

In addition, although the apparatus has been illustrated as being applied to the production of an aluminum-carbon nanotube composite material above, it should be understood that this is merely illustrative, and the apparatus for producing a composite material according to the present invention may also be used for other products in addition to the aluminum-carbon nanotube composite material.

Therefore, the scope of the present invention should be limited only by the accompanying claims and equivalents thereof.

The invention claimed is:

1. An apparatus for producing a composite material, comprising:

a first injection tube supplying a dispersion medium;

a reservoir connected to the first injection tube and receiving the dispersion medium through the first injection tube;

a second injection tube connected to the reservoir and supplying dispersion particles;

a discharge tube connected to the reservoir and the second injection tube and discharging a mixture of the dispersion medium supplied from the reservoir and the dispersion particles supplied from the second injection tube; and a free surface inversion unit directing a free surface of a liquid in the second injection tube vertically downward such that the dispersion medium and the dispersion particles are mixed with each other inside the discharge tube;

wherein the free surface inversion unit comprises:

a coil generating an induced current inside the reservoir;

an electromagnet disposed at a connection portion between the second injection tube and the discharge tube.

2. The apparatus according to claim 1, wherein the reservoir is formed of a closed loop pipe, and the discharge tube communicates with the reservoir and extends upward therefrom.

3. The apparatus according to claim 1, wherein the electromagnet controls Lorentz force by generating a magnetic field in a direction perpendicular to the induced current of the coil.

4. The apparatus according to claim 1, further comprising:

a cooling unit provided on the discharge tube and cooling a composite material, is the mixture of the dispersion medium and the dispersion particles; and an extraction unit drawing up the composite material discharged from the cooling unit.

* * * * *